United States Patent [19]

Hazelbaker

[11] 4,280,538

[45] Jul. 28, 1981

[54] INSULATION PACKAGING MACHINE

[76] Inventor: Dale P. Hazelbaker, 9030 Carroll Way #6, San Diego, Calif. 92121

[21] Appl. No.: 50,986

[22] Filed: Jun. 22, 1979

[51] Int. Cl.[3] ..... B65B 1/12

[52] U.S. Cl. ..... 141/73; 141/114; 141/256; 141/283; 141/316; 141/370; 141/390; 53/530; 198/663

[58] Field of Search ..... 141/10, 114, 313–317, 141/283, 252, 256, 257, 12, 71, 73, 231–233, 369, 370, 390; 53/523, 530; 198/558, 616, 662, 663

[56] References Cited

U.S. PATENT DOCUMENTS

| | | | |
|---|---|---|---|
| 2,553,684 | 5/1951 | Soulen | 141/257 |
| 4,054,018 | 10/1977 | Neukom | 141/257 |
| 4,078,653 | 3/1978 | Suter | 198/663 |

*Primary Examiner*—Houston S. Bell, Jr.

*Attorney, Agent, or Firm*—Charmasson, Branscomb & Holz

[57] ABSTRACT

A machine and method of packaging loose fill material such as fiber insulation into a rectilinear bag is described consisting of a storage tank above a trough enclosing twin counter rotating augers which forcibly drive the loose fill material into a passageway over which the bag is stretched, forcing the bag off the stretcher as it is filled. A hinged can assembly contains the bag and is guided along a track as the bag is filled and forcibly moved off the stretcher, presenting the filled bag to an operator who removes it and seals the bag.

3 Claims, 8 Drawing Figures

INSULATION PACKAGING MACHINE

BACKGROUND OF THE INVENTION

Handling loose granular and fibrous materials in the process of removing them from storage and placing them in packages for shipment to point of application or consumption has presented many problems varying with the characteristics of the stored material and type of packaging. Solutions in the art have been equally varied and exist for many types of material. A contemporary problem with which the within invention is concerned is handling and packaging of loose fill treated cellulose fiber insulation. The growing awareness of the need for energy conservation has expanded the insulation industry in general. Cellulose insulation is inexpensive and available for a variety of applications, but presents unique handling and packaging problems as well. Treated cellulose insulation is commonly manufactured by a shredding and pounding process in which common scrap paper is processed and chemically treated resulting in a fluffy fibrous mass. The material can be compressed for handling and packaging by a factor of four or five from its manufactured volume and it is re-expanded at the application point by a blowing machine that both carries it to the point of application, typically a residential attic space, and increases the volume of the material and thus its insulation value. The same compressibility and fibrous characteristics, however, present problems in the packaging process. The material can be difficult to pack into a conveniently package of a controlled, predictable weight. The material tends to bind in a confined loading passageway within a machine because of its cohesive fibrous nature. Additionally, the compression of the material as it is packaged can vary widely if not closely metered by a precisely controlled flow process.

The within invention seeks to provide a precise and trouble-free continuous processing of the cellulose insulation material from its stored to packaged state. Ideally, a machine to accomplish this objective would be adaptable to existing manufacturing and storage equipment and able to accomplish the packaging process using commonly available types of packaging bags, and be as nearly automatic as possible to avoid imposing high labor costs on an already close margin manufactured product.

Thus it is an object of the within invention to provide a means of packaging cellulose insulation material that is adaptable to existing manufacturing and storage equipment for such material.

Another object of the within invention is to provide a means of packaging cellulose insulation material that will positively and precisely pack controlled amounts of the material in a given package volume.

Another object of the within invention is to provide a positive flow means between the storage and packaging points that will be jam-free.

Another object of the invention is to provide process of packaging cellulose insulation material as nearly automatic as economically possible.

SUMMARY OF THE INVENTION

The invention herein described seeks to accomplish the above objectives by providing a linear trough containing counter rotating twin augers mounted beneath an existing storage bunker to receive and transport the fibrous cellulose insulation material which falls into the twin augers by gravity feed. The bunker further contains rotary stirring blades or paddles mounted on a hub which move the material over the gravity feed hole providing continuous feed. The augers receive the material and drive it forward into a snout-like passageway which is constructed to the inside dimensions of the packaging bag. In this case, a rectilinear volume which is convenient for stacking and transportation of the filled packages. A plastic bag of that shape open at one end is stretched over the snout and a hinged can assembly which rides on parallel tracks fits over the bagging snout. As the insulation material is forced by the augers into the snout and thus into the bag, the filling pressure forces the bag and the can assembly which contains it progressively off the snout until it is filled, supported by the can assembly riding along the parallel tracks by a carriage assembly. Compression of the insulation as it is filled in the bag is controlled by back pressure provided by air cylinders attached to the moving can assembly. When the bag and can assembly is filled, a limit switch is engaged by the carriage which stops the augers and shuts off air to the restraining pneumatic cylinders and reverses the air flow in order that the pneumatic cylinders will move the can assembly further down the track. The final movement on the track allows the bag and can assembly to move from a horizontal to vertical position where it meets a stop. The can is then opened by an operator, the bag removed, and manually sealed by the operator.

The cycle is repeated by again placing a bag over the filling snout, closing the can assembly, and actuating a switch which then reverses the direction of the can assembly pneumatic cylinders, pulling the can up the track and over the bagging snout. When the can is in position, the carriage again engages a limit switch that restarts the filling augers and provides back pressure air to the pneumatic cylinders.

Thus the within invention accomplishes the packaging process of this fibrous material through a simple and quickly repeated cycle involving minimal manual assistance. The process here described can be further adapted to accommodate any loose fill, granular or fibrous material that could be contained within a storage tank and processed for packaging as grain or silage, for instance.

DESCRIPTION OF THE PREFERRED EMBODIMENT

Figure 1:
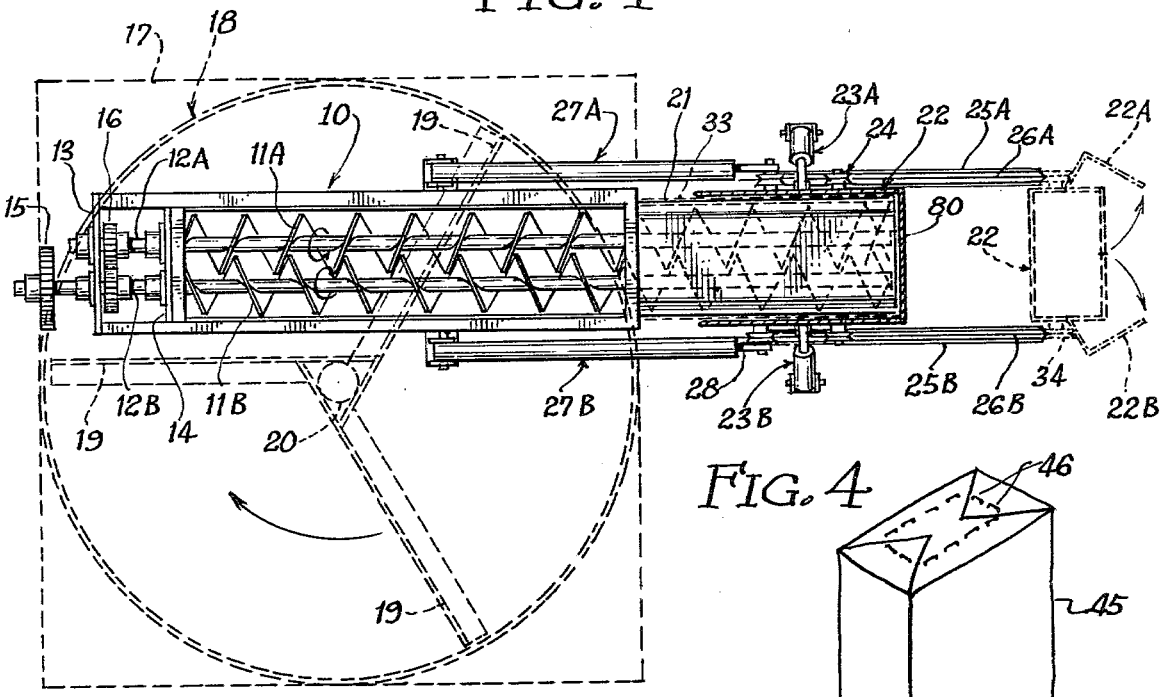
FIG. 1 is a plan view of the packaging machine further showing the storage bunker in phantom view.

Referring to the drawings, FIG. 1 describes the concept as applied to a standard storage tank installation. A rectangular trough 10 of metallic construction is open at the top as presented in the plan view and supports and contains twin counter rotating augers 11A and 11B. The augers are supported by end shaft sections 12A and 12B, respectively, by an adjustable bearing plate 13 and a fixed bearing plate 14. The support provided by both these bearing plates is sufficient to allow the augers to project into the trough without further support in cantilever fashion. The end shaft of one of the augers is fitted with a drive sprocket 15 which may be either directly driven by an electric motor (not shown), or a chain engaged by a remotely mounted motor. The rotational force transmitted to one auger via the drive sprocket is also transmitted to the twin auger via counter rotating engaged gears 16.

A portion of the helical flanges of the augers overlap, as shown, which effectively prevents jamming of material common to single auger feed mechanisms. Any binding material in one auger will be dislodged by the other auger where they overlap, and forced further forward.

A typical existing storage tank is shown in position with relation to the conveyor trough in phantom view, including a planar table 17 supporting a storage bunker 18. Material contained within the storage bunker is stirred by rotating blades 19 mounted on hub 20 which serves to maintain the appropriate consistency of the stored material as well as move the material to be loaded over the augers. The bunker installation is joined to the conveyor trough by simply cutting a hole in the bottom of the bunker of the same dimension of the opening at the conveyor trough and the units may be joined by welding or bolts.

The stored cellulose insulation material thus will be transported in the bunker over the hole and gravity feed into the counter rotating augers, and forced forward into the loading machine in a left to right direction as shown. As the material advances within the augers it is moved into a four-sided portion of the trough shown as snout section 21. The snout is a continuation of the trough with the exception that it is closed at the top side as shown on the plan view, providing a four-sided passageway open at one end to the auger trough and at the other end to the packaging operation. The augers continue into the snout section as shown in hidden view. The snout section conforms in shape to the inside dimensions of the packaging container, typically a plastic or heavy paper bag, which is slipped over the snout and further contained around its outside dimension by loading can assembly 22. The loading can is a hinged enclosure as will be later shown which when in position over the loading snout is constrained by closure cylinder assemblies 23A and 23B. The entire can and closure assemblies ride on carriage assembly 24 which in turn moves along parallel support rails 25A and 25B guided by track 26A and 26B and as will be seen, both restrained and propelled by pneumatic cylinder assemblies 27A and 27B which are affixed to the trough frame. The piston rod 28 is in turn connected to the carriage assembly 24.

It can be clearly seen from this view that the stored cellulose insulation material will move via the stirring blades over the gravity feed hole of the bunker, falling into the twin counter rotating augers and be moved forward into the loading snout. As the material is moved into the snout by the two augers it will press against the closed bottom of the bag fitted over the snout and in turn against the bottom of can assembly 22, forcing the bag and can assembly from left to right along the support rails 25 and track 26. The can assembly and bag supported by the carriage 24 will move in this horizontal orientation until the forward roller of the carriage assembly reaches the end of the horizontal section of the track. The can containing the filled bag then moves to the vertical position and closure cylinder assemblies 23 are manually actuated opening doors 22A and 22B. The filled package may then be moved by the operator.

Figure 2:
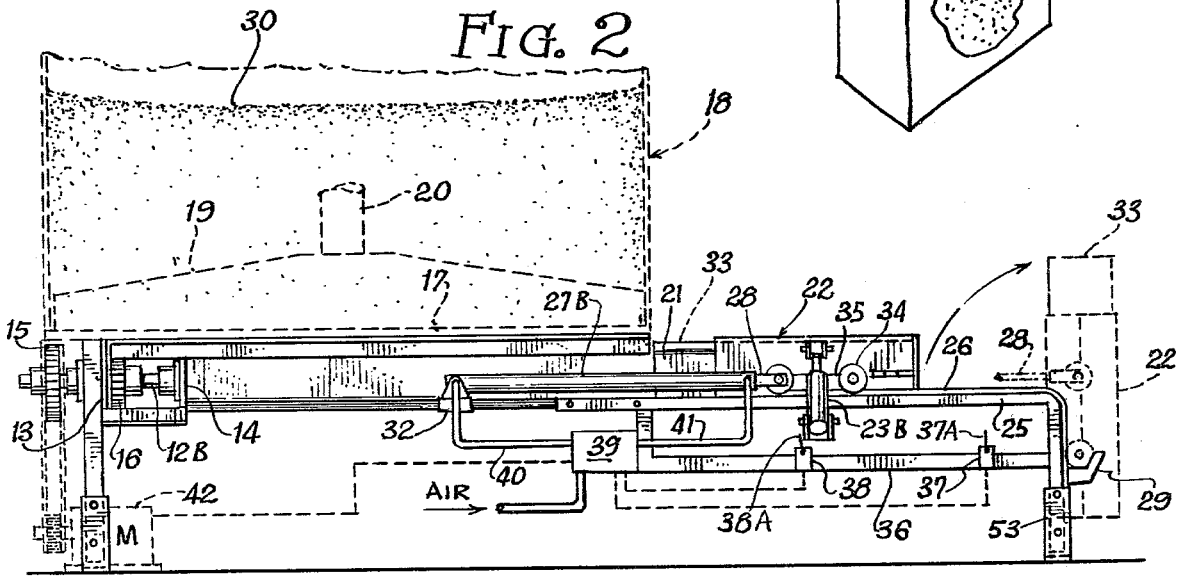
FIG. 2 is a side view of the packaging machine showing the storage bunker and contained material in phantom view.

FIG. 2 further illustrates the configuration and operation of the device in side view of the packaging machine. Storage bunker 18 shown in phantom view contains a volume of cellulose insulation material 30 which is continuously stirred by blades 19 driven by motor (not shown) via hub 20. Although the augers are hidden in this view the drive sprocket 15 and end shaft 12B of the driven auger are clearly visible extending into the trough 10 and auger snout 21. The side view more clearly reveals that rail 25 and track 26 are constructed to maintain the loading can and carriage assembly in horizontal position until it moves to the far right end of the track, at which point it is allowed to assume a vertical position by following the vertical section of the track to the cradle stop 29 welded to the track as shown in phantom view of the can assembly 22 at its vertical position containing bag 33. It can also be clearly seen in this view that pneumatic cylinder 27 controls the movement of loading can 22 as it is permanently affixed in relation to the trough by cylinder bracket 32 and piston rod 28 is affixed to carriage 35 which rides on the track via carriage rollers 34. As before described, the loading pressure of the fill material against the closed bottom of the bag and loading can will move the can and carriage assembly from left to right along the track as shown extending piston rod 28 from the pneumatic cylinder. The rate of movement, and indirectly the density of the fill material, is regulated by pneumatic back pressure against the internal piston of the pneumatic cylinder provided by air line 41 from controller 39. As the can and bag assembly move horizontally the bracket supporting closure cylinder assembly 23B which is moving with the can assembly will contact a limit switch 37 via a wire whisker contact 37A. The switches are supported by a bar 36 parallel to the horizontal track section. The switching signal generated by the limit switch is transmitted to the controller 39, shown symbolically, which accomplishes the switching operations of the electric motors and pneumatic air source which power the operation. At this operational juncture the controller causes the back pressure to the pneumatic cylinder by airline 41 to shut off and provides air pressure to the other side of the piston by air line 40 to positively power piston rod 28 and thus the further movement of the carriage and can assembly. At the same time the controller shuts off electric power to the auger motor 42 which stops the force of the fill material into the bag and can assembly.

The can assembly thus continues movement from left to right along the track. At this point the forward carriage roller 34 reaches the end of the horizontal track section and is constrained to move vertically downward as the track section guides it and as it is forced by the over center weight of the can extending past the horizontal track section. The piston rod attached to the trailing carriage roller, however, maintains its horizontal orientation moving the entire assembly further along the track. Thus the can containing the filled bag moves through a tipping motion which shears the material packed into the bag from the continuous feed train of cellulose material at the open end of the loading snout 21. Finally, the forward carriage roller will engage cradle stop 29, stopping the vertical motion of the can and the piston rod 28 will reach its fully extended position. The can is now presented to the operator who will open the hinged can and remove the filled package. He restarts the cycle by closing the hinged can and manually actuating a switch (not shown) which directs the controller to reverse the air pressure to pneumatic cylinder 27, again providing reverse pressure via air line 41 which will cause piston rod 28 to withdraw into the cylinder, drawing the can 22 from the vertical to horizontal position and horizontally into position over the loading snout 21 onto which the same or another operator has already placed another bag 33. When the can is completely placed over the loading snout, the closure assembly bracket will contact a second limit switch 38 via a whisker 38A. The limit switch directs the controller 39 to restart the counter rotating auger drive motor 42 and the packaging cycle continues. Although the air to the pneumatic cylinder continues in the same direction as the recycle step, it provides adjustable back pressure to the carriage movement which is reversed by filling pressure. The controller 39 adjusts the density of fill by adjusting the pneumatic back pressure.

Figure 4:
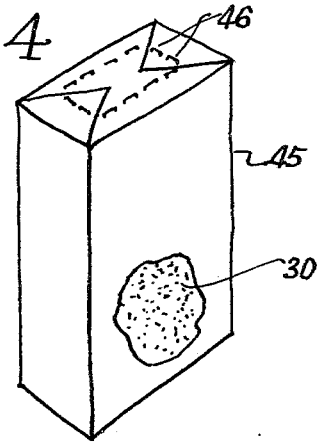
FIG. 4 is a representation of the package in its finished filled condition.
Figure 3:
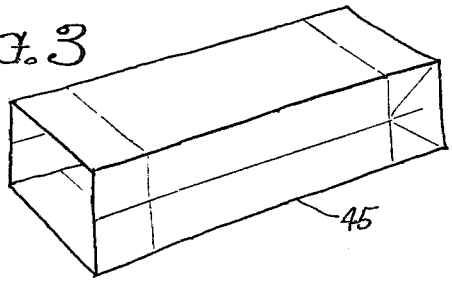
FIG. 3 is a representation of the shape of the package for which the invention is designed.
Figure 5:
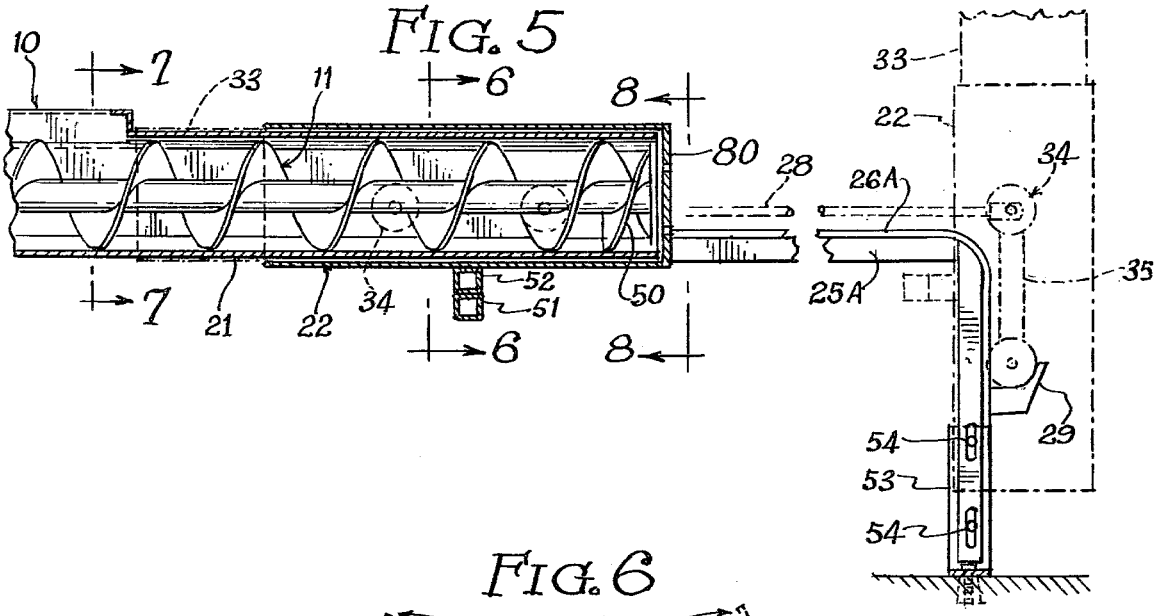
FIG. 5 is a cross sectional view of a portion of the packaging machine disclosing the interior of the packaging snout.

FIG. 3 shows a typical bag shape 45 in horizontal position open at one end for fitting over the auger snout and closed at the other end. FIG. 4 shows the package removed from the can assembly following loading. The packaging process is manually completed by folding the open flaps of the bag and securing it by staples 46 to a rigid piece of fiberboard placed within the package. Thus a package of exact volume and shape, and controlled weight, are presented for further storage and transportation. FIG. 5 illustrates in greater detail the containment of the transporting auger 11 within the packaging snout 21 and further illustrates that the auger which contains a single spiral flight throughout most of its length additionally supports a second spiral flight 50 at the last 180° around the shaft at the open end of the snout. The purpose of the extra spiral flight is to prevent excessive spillage of the loose fill material at the end of the packaging snout when the filled bag and can are removed.

FIG. 5 also illustrates in cross section that the passage of the trough 10 is continuous but transitions at the location of section line 7—7 from an open loading trough to a closed passageway snout 21, forcing the fill material to conform to the shape of the snout as it is passed by the auger. Bag 33 is shown in section placed over the snout and contained around its outer dimension by can assembly 22. The section of the can assembly reveals that it also supports a support beam 51 via spacer beam 52 which it will be seen in the next figure supports in turn the hydraulic closure cylinders of the can assembly.

FIG. 5 also illustrates in greater detail via shadow view that the end cycle position of the can assembly tips to a vertical position restrained by cradle stop 29 which engages the forward carriage roller, but that the back carriage roller propelled by a piston rod 28 maintains a level position throughout its plane of movement and acts as the swivel point between the horizontal and vertical positions of the can. Filled bag 33 is shown in this view protruding from the top of the can assembly ready for removal and staple closure. Finally, this view also illustrates that the vertical support section of track 25A is adjustably connected to a U-shaped footing 53 which is anchored to the floor and connected thereto by bolts 54. The vertical support section of the track thus can be slidably adjusted within the footing along the range of the bolt channel provided.

Figure 6:
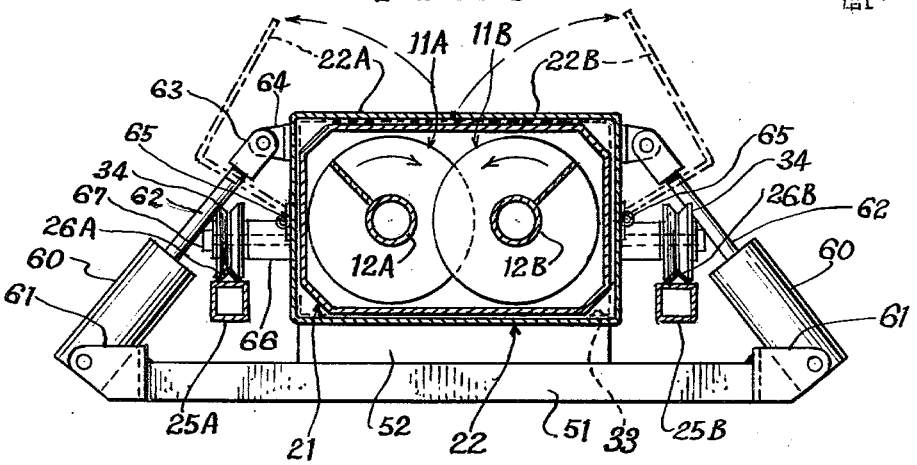
FIG. 6 is a cross section along line 6—6 of FIG. 5 through the packaging snout and can assembly.

FIG. 6 illustrates the operation of the hinged can assembly in cross section along line 6—6 of FIG. 5. The can assembly 22 is shown in place surrounding loading snout 21. In this view it can also be seen that the loading snout closely contains the overlapping twin augers 11A and 11B by bevels at the four corners which leave little space outside the perimeter of the augers for boundary layer drag of the loose fill material. Thus the material is efficiently transported through the passageway. Further, the beveled corners enable the rectangular cross section bag to be easily slipped over the snout section manually by providing space at the outside of the beveled corners for air to escape as the bag is loaded over the snout.

FIG. 6 illustrates, as well, that the entire can assembly including the support beam 51 and spacer 52 travels along the length of rails 25A and 25B and tracks 26A and 26B which in turn engage carriage rollers 34. The rollers support the entire can assembly by spacer 66 and axle bolt 67.

It can be clearly seen in FIG. 6 that the can assembly which is shown in cross section to enclose the loading snout can be opened for removal of the loaded bag as previously described by opening hinge sections 22A and 22B. During the loading cycle the hinged sections are held in the closed position by the hydraulic closure assemblies consisting of cylinder 60 powered by a reversible hydraulic source (not shown). The cylinder is supported in relation to the can assembly by support beam 51 attached to the cylinder 60 by bracket 61. The reversible action of the hydraulic assembly is transmitted to the hinged doors via piston rods 62 and its swivel fitting 63 held by a pin to door clevis 64. When the can assembly reaches its vertical end position, the operator manually actuates the closure cylinders which retract, drawing the doors 22A and 22B which are hinged at hinge 65 to the open position shown in phantom view in FIG. 6. The filled bag is then removed and stapled closed.

Figure 7:
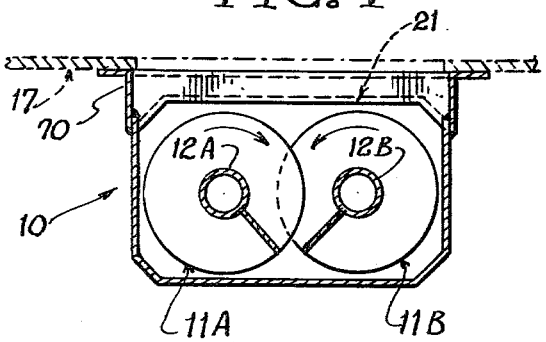
FIG. 7 is a cross sectional view across line 7—7 of FIG. 5 disclosing the interior of the trough.

The cross sectional view of FIG. 7 discloses that the trough 10 containing the augers 11A and 11B may be secured to the existing bunker table 17 via a right angle bracket welded to the table and upper opening of the trough around the sides of the trough and across the fixed bearing plate. Thus, it can be seen that the trough assembly can be easily adapted to any type of raised storage bunker and requires no other supporting installation other than the attachment to the bunker via brackets 70 and the support provided at the other end of the device by the vertical track section previously described and shown in FIG. 5.

Figure 8:
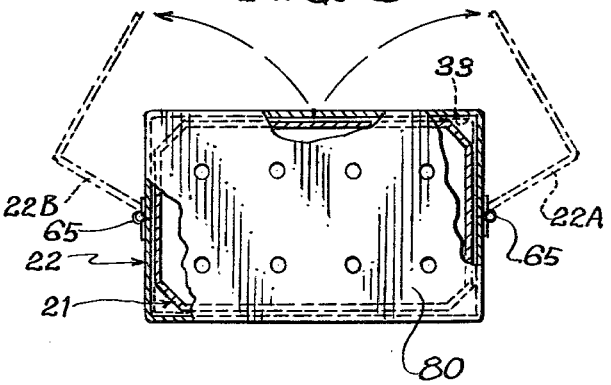
FIG. 8 is a cross section across line 8—8 of FIG. 5 showing the configuration of the can assembly.

FIG. 8 further illustrates the configuration of the can assembly showing the doors in both their closed position and open position in phantom view, and showing that the closed bottom section 80 of the can assembly contains numerous holes or perforations provided in order that air can be conveniently exhausted as the can assembly is cycled over the bag and loading snout.

Having thus described my invention, I claim:

1. A machine for packaging loose-fill material into bags, comprising a trough adapted to receive fill material from a storage tank, said trough enclosing dual overlapping counter rotating helical motor driven augers, a portion of said trough being closed on four sides and having an open outlet end such as a bag may be placed over said portion such that as fill material is transported by the augers into the enclosed portion of the trough the bag will be filled and forced off the trough by the transported volume of fill material, and including a pair of guide rails and a roller carriage free to move along said rails, said roller carriage supporting a can adapted to fit over the bag and enclosed portion of the trough, carriage and can being movable from a position in which the bottom of said can is adjacent said open outlet to a position free of said trough as it is filled and forced off the trough by the transported volume of fill material.

2. The device of claim 1 wherein said can includes two openable clamshell doors and each of said rails includes a horizontal portion curving downwardly into a vertical portion such that the carriage and can will travel position from a horizontally extended position to a vertically extended position at the end of its range of motion along the rail such that a sack placed in said can finishes its cycle open-end up and accessible by opening said clamshell doors for sealing and removal.

3. The device according to claim 2 wherein said carriage defines two spaced roller pairs engaged on said rails and including at least one bi-directional pneumatic cylinder longitudinally extended along said rails and having a fixed end and an end pivoted to said carriage such that expansion of said cylinder drives said carriage into said vertically extended position and contraction of said cylinder brings said can into increasingly close proximity to said open outlet.

* * * * *